US010527972B2

(12) United States Patent
Saito et al.

(10) Patent No.: US 10,527,972 B2
(45) Date of Patent: Jan. 7, 2020

(54) IMAGE FORMING APPARATUS

(71) Applicant: CANON KABUSHIKI KAISHA, Tokyo (JP)

(72) Inventors: Shuji Saito, Suntou-gun (JP); Ken Yokoyama, Mishima (JP); Noriaki Egawa, Komae (JP); Koujirou Izumidate, Chiba (JP); Masatsugu Toyonori, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/383,192

(22) Filed: Apr. 12, 2019

(65) Prior Publication Data

US 2019/0332038 A1 Oct. 31, 2019

(30) Foreign Application Priority Data

Apr. 27, 2018 (JP) ..... 2018-087524

(51) Int. Cl.
*G03G 15/14* (2006.01)
*G03G 15/00* (2006.01)
*G03G 15/16* (2006.01)

(52) U.S. Cl.
CPC ..... *G03G 15/14* (2013.01); *G03G 15/1605* (2013.01); *G03G 15/5054* (2013.01)

(58) Field of Classification Search
CPC ..... G03G 15/5054; G03G 15/5058; G03G 15/1605; G03G 15/162; G03G 15/14
See application file for complete search history.

(56) References Cited

U.S. PATENT DOCUMENTS 6,016,417 A * 1/2000 Katsuno ..... G03G 15/162 399/308
2007/0237553 A1* 10/2007 Namba ..... G03G 15/161 399/302
2010/0300604 A1* 12/2010 Goss ..... B41J 2/0057 156/154
2013/0051838 A1* 2/2013 Takazawa ..... G03G 15/0194 399/101

(Continued)

FOREIGN PATENT DOCUMENTS

JP 2005-128510 A 5/2005
JP 2015-106138 A 6/2015
JP 2015125187 A 7/2015

*Primary Examiner* — Sevan A Aydin
(74) *Attorney, Agent, or Firm* — Canon U.S.A., Inc. IP Division

(57) ABSTRACT

An intermediate transfer belt includes, on a surface in contact with a photosensitive drum and a cleaning blade, a plurality of grooves formed along a moving direction of the intermediate transfer belt in a width direction which intersects the moving direction of the intermediate transfer belt. Further, the intermediate transfer belt includes a plurality of first regions in which adjacent grooves in the width direction are arranged at a predetermined interval, and a second region which is positioned between the plurality of first regions and in which an interval between adjacent grooves in the width direction is different from the predetermined interval. The second region is arranged outside, in the width direction of the intermediate transfer belt, a range in which a patch toner is to be formed in concentration correction.

13 Claims, 10 Drawing Sheets

(56) References Cited

U.S. PATENT DOCUMENTS

2015/0177653 A1* 6/2015 Seki ..... G03G 15/162
399/101
2016/0378036 A1* 12/2016 Onishi ..... G03G 15/5054
399/302

* cited by examiner

IMAGE FORMING APPARATUS

BACKGROUND OF THE DISCLOSURE

Field of the Disclosure

The present disclosure relates to an electrophotographic image forming apparatus, such as a copying machine and printer.

Description of the Related Art

Electrophotographic color image forming apparatuses employing an intermediate transfer method have been made available. In the intermediate transfer method, toner images are sequentially transferred from image forming units of different colors onto an intermediate transfer member and then the transferred toner images are collectively transferred from the intermediate transfer member onto a transfer material.

In such an image forming apparatus, each of the image forming units includes a drum-shaped photosensitive member (hereinafter, referred to as "photosensitive drum") as an image bearing member. As the intermediate transfer member, an intermediate transfer belt formed as an endless belt is widely used. A primary transfer power source applies a voltage to a primary transfer member arranged to face the photosensitive drum via the intermediate transfer belt, so that the toner images formed on the photosensitive drums of the image forming units are primarily transferred onto the intermediate transfer belt. A secondary transfer power source applies a voltage to a secondary transfer member at a secondary transfer portion, so that the toner images of the respective colors that are primarily transferred from the image forming units of the respective colors onto the intermediate transfer belt are secondarily transferred collectively from the intermediate transfer belt onto a transfer material, such as a sheet or overhead projector (OHP) sheet. Thereafter, the transferred toner images of the respective colors on the transfer material are fixed to the transfer material by a fixing unit.

In the image forming apparatus employing the intermediate transfer method, toner remains on the intermediate transfer belt after the second transfer of the toner images from the intermediate transfer belt onto the transfer material (residual untransferred toner). Thus, the residual untransferred toner remaining on the intermediate transfer belt needs to be removed before toner images corresponding to a next image are primarily transferred onto the intermediate transfer belt.

As a method for removing residual untransferred toner, a blade cleaning method is a widely used. In the blade cleaning method, the residual untransferred toner is scraped and collected into a cleaning container by a cleaning blade which is a contact member in contact with the intermediate transfer belt and is arranged downstream of the secondary transfer portion in a moving direction of the intermediate transfer belt. In general, an elastic member, such as an urethane rubber, is used as the cleaning blade. The cleaning blade is often arranged in a state in which an edge portion of the cleaning blade is pressed against the intermediate transfer belt from a direction (counter direction) that is opposite to the moving direction of the intermediate transfer belt. At this time, a collection nip portion for collecting the residual untransferred toner is formed at the position at which the cleaning blade is in pressure contact with the intermediate transfer belt.

In recent years, there is a demand for an image forming apparatus with increased durability, and thus an image forming apparatus using the blade cleaning method needs to provide improved durability against repeated use. Japanese Patent Application Laid-Open No. 2015-125187 discusses a structure in which a groove is formed on a surface of an intermediate transfer belt along a moving direction of the intermediate transfer belt so that a coefficient of friction between a cleaning blade and the intermediate transfer belt is decreased, in order to prevent abrasion of the cleaning blade and increase durability. Moreover, Japanese Patent Application Laid-Open No. 2015-125187 discusses that a groove shape can be formed on the surface of the intermediate transfer belt using a lapping film, mold, or nanoimprint technology.

In a case of forming a groove on an intermediate transfer belt using a mold having a surface with a protruding shape formed thereon, the mold or the intermediate transfer belt is rotated with the mold being pressed against a surface of the intermediate transfer belt, thus providing a groove shape on the intermediate transfer belt. At this time, if the pressure applied to press the mold against the intermediate transfer belt is high, the mold can be deformed, which may cause un-uniformity (or non-uniformity) in the groove shape formed on the surface of the intermediate transfer belt in a longer-side direction of the mold (width direction of the intermediate transfer belt which intersects a moving direction of the intermediate transfer belt). In the case in which the groove shape is not uniform in the longer-side direction of the mold, the coefficient of friction between the cleaning blade and the intermediate transfer belt varies, so that the amount of abrasion of the cleaning blade in the longer-side direction of the mold also varies.

In order to reduce or prevent change in an image due to change in an surrounding environment or deterioration of the image forming apparatus with time, correction control is performed in the image forming apparatus to correct image forming conditions, such as an image concentration and image forming position, at a timing that satisfies a predetermined condition. More specifically, a toner image for detection (hereinafter, referred to as "patch toner") is formed on the intermediate transfer belt, and a detection unit detects concentration-related information and position-related information about the formed toner image and transmits the detected information as feedback to a control unit, thus correcting the image forming conditions, such as the image concentration and image forming position. The patch toner formed in the correction control is greater in amount and in toner charge than the residual untransferred toner remaining after the secondary transfer from the intermediate transfer belt to the transfer material. Thus, the patch toner is liable to tenaciously adhere to the intermediate transfer belt.

Thus, if the amount of abrasion of the cleaning blade in the longer-side direction of the mold varies as described above, the patch toner can slip through a cleaning brush at a position at which the variation is significant, which can cause a cleaning defect.

SUMMARY OF THE DISCLOSURE

The present disclosure is directed to a technique for preventing or reducing a cleaning defect caused by a toner image for detection slipping through a contact member, while improving the durability of the contact member in a structure in which the contact member in contact with an intermediate transfer member collects toner remaining on the intermediate transfer member.

According to an aspect of the present disclosure, an image forming apparatus includes an image bearing member configured to bear a toner image, an intermediate transfer member which is movable and is in contact with the image bearing member, the toner image borne on the image bearing member being primarily transferred onto the intermediate transfer member, a collection unit which is provided downstream, in a moving direction of the intermediate transfer member, of a secondary transfer portion in which the primarily-transferred toner image on the intermediate transfer member is secondarily transferred from the intermediate transfer member onto a transfer material, wherein the collection unit includes a contact member in contact with the intermediate transfer member, and is configured to collect, using the contact member, toner remaining on the intermediate transfer member after the toner image passes through the secondary transfer portion, a detection unit configured to detect a toner image for detection which is transferred from the image bearing member onto the intermediate transfer member, and a control unit configured to execute, based on a result of detection by the detection unit, correction control to correct an image forming condition for forming an image using the toner image. The intermediate transfer member includes, on a surface thereof in contact with the image bearing member and the contact member, a plurality of grooves formed along the moving direction with respect to a width direction of the intermediate transfer member which intersects the moving direction. The intermediate transfer member includes a plurality of first regions in which adjacent grooves of the plurality of grooves in the width direction are arranged at a predetermined interval, and a second region which is positioned between the plurality of first regions and in which an interval between adjacent grooves of the plurality of grooves in the width direction is different from the predetermined interval, the second region being arranged outside, in the width direction, a range in which the toner image for detection is to be formed in the correction control.

Further features and aspects of the present disclosure will become apparent from the following description of embodiments with reference to the attached drawings.

DESCRIPTION OF THE EMBODIMENTS

Various embodiments of the present disclosure will be described in detail below with reference to the accompanying drawings. It should be noted that dimensions, materials, shapes, and relative positions of components described in the embodiments below are to be changed as suitable for a structure of an apparatus to which the present disclosure is applied and various conditions and, thus, are not intended to limit the scope of the disclosure, unless otherwise specified.

Figure 1:
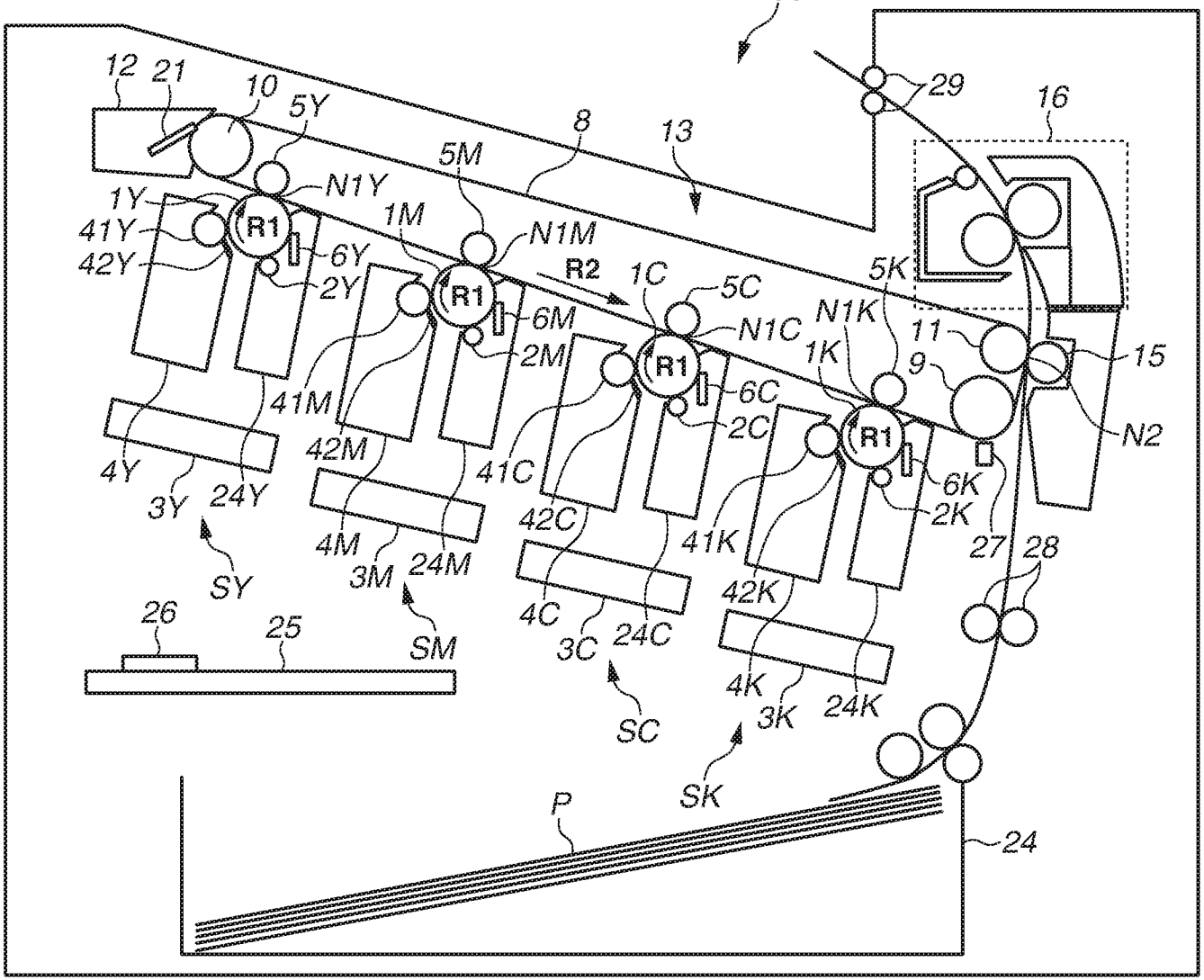
FIG. 1 is a schematic section view illustrating a simplified structure of an example image forming apparatus.

A first embodiment of the present disclosure will be described below in detail. FIG. 1 is a schematic section view illustrating a simplified structure of an image forming apparatus 100 according to the present embodiment. The image forming apparatus 100 according to the present embodiment is a tandem-type laser beam printer that is capable of forming a full-color image using an electrophotographic method and employs an intermediate transfer method.

The image forming apparatus 100 includes four image forming units SY, SM, SC, and SK which are aligned. The image forming units SY, SM, SC, and SK respectively form yellow (Y), magenta (M), cyan (C), and black (K) images. In the present embodiment, the structures and operations of the image forming units SY, SM, SC, and SK are substantially similar except that the colors of the toners used by the image forming units SY, SM, SC, and SK are different. Thus, hereinafter, the image forming units SY, SM, SC, and SK will be described collectively without the symbols "Y", "M", "C", and "K" at each end, which indicate the colors for which the image forming units SY, SM, SC, and SK are provided, unless the image forming units SY, SM, SC, and SK need to be discriminated.

The image forming unit S includes a drum-shaped (cylindrical) photosensitive drum 1 as an image bearing member. The photosensitive drum 1 is driven and rotated in the direction of an arrow R1 specified in the drawings at a predetermined processing speed (210 mm/sec in the present embodiment). Around the photosensitive drum 1 are provided a charging roller 2, an exposure unit 3, a development unit 4, and a drum cleaning unit 6 in this order along the rotation direction of the photosensitive drum 1. The charging roller 2 is a roller-shaped charging member as a charging unit. The drum cleaning unit 6 collects residual toner remaining on the photosensitive drum 1.

The development unit 4 stores a non-magnetic single-component development agent as a development agent and includes a development sleeve 41 and a development agent application blade 42. The development sleeve 41 is a development agent bearing member, and the development agent application blade 42 is a development agent regulation unit. In each image forming unit S, the photosensitive drum 1, the charging roller 2 as a processing unit which acts on the photosensitive drum 1, the development unit 4, and the drum cleaning unit 6 are integrated as a process cartridge which is attachable to and detachable from the body of the image forming apparatus 100. The exposure unit 3 includes a scanner unit that performs scan with laser light using a polygonal mirror, and applies a scan beam modulated based on an image signal to the photosensitive drum 1.

An intermediate transfer belt 8 formed in the shape of an endless belt as a movable intermediate transfer member having a length of 250 mm in a width direction of the intermediate transfer belt 8 and a circumferential length of 712 mm is provided in such a manner that the intermediate transfer belt 8 is in contact with all the photosensitive drums 1Y, 1M, 1C, and 1K of the image forming units SY, SM, SC, and SK. The intermediate transfer belt 8 is stretched by three rollers, a driving roller 9, a stretching roller 10, and a secondary transfer opposite roller 11 (hereinafter, referred to simply as "opposite roller 11"). The driving roller 9 is driven and rotated to thereby move (rotate) the intermediate transfer belt 8 in a belt conveyance direction specified by an arrow R2. The width direction of the intermediate transfer belt 8 is orthogonal to the moving direction of the intermediate transfer belt 8, which is specified by the arrow R2 in the drawings, and is a depth direction in FIG. 1.

A primary transfer roller 5 as a primary transfer member is provided at a position facing the photosensitive drum 1 via the intermediate transfer belt 8. The primary transfer roller 5 is biased at a predetermined pressure against the photosensitive drum 1 via the intermediate transfer belt 8 and forms a primary transfer portion (primary transfer nip) N1 at which the intermediate transfer belt 8 and the photosensitive drum 1 are in contact. Further, a secondary transfer roller 15 as a secondary transfer member is provided on the outer surface side of the intermediate transfer belt 8 at a position facing the opposite roller 11. The secondary transfer roller 15 is biased at a predetermined pressure against the opposite roller 11 via the intermediate transfer belt 8 and forms a secondary transfer portion (secondary transfer nip) N2 at which the intermediate transfer belt 8 and the secondary transfer roller 15 are in contact.

A belt cleaning unit 12 as a collection unit is provided on the outer surface side of the intermediate transfer belt 8 at a position facing the stretching roller 10. The intermediate transfer belt 8 supported by the above-described rollers 9, 10, and 11 and the belt cleaning unit 12 are formed as a unit, and an intermediate transfer belt unit 13 is formed which is removable from the body of the image forming apparatus 100.

In response to an image forming operation being started, the photosensitive drum 1 and the intermediate transfer belt 8 start rotating at predetermined processing speeds in the directions of the arrows R1 and R2, respectively. The rotating surface of the photosensitive drum 1 is substantially uniformly charged by the charging roller 2 to a predetermined polarity (which is negative in the present embodiment). At this time, a charging power source (not illustrated) applies a predetermined charging voltage to the charging roller 2. Thereafter, the photosensitive drum 1 is exposed by the exposure unit 3 based on image information corresponding to the image forming unit S, thus forming an electrostatic latent image based on the image information on the surface of the photosensitive drum 1.

The development sleeve 41 bears toner charged to a normal charging polarity of the toner (which is negative in the present embodiment) by the development agent application blade 42, and a development power source (not illustrated) applies a predetermined development voltage to the development sleeve 41. Thus, the latent image formed on the photosensitive drum 1 is visualized by the negatively-charged toner at a facing portion (development portion) at which the photosensitive drum 1 and the development sleeve 41 face each other, and a toner image is formed on the photosensitive drum 1.

Next, the toner image formed on the photosensitive drum 1 is transferred (primary transfer) onto the intermediate transfer belt 8, which is driven and rotated, at the primary transfer portion N1 by the action of the primary transfer roller 5. At this time, a primary transfer power source (not illustrated) applies a primary transfer voltage having a polarity opposite to the normal charging polarity of the toner (which is positive in the present embodiment) to the primary transfer roller 5. For example, in forming a full-color image, an electrostatic latent image is formed on each of the photosensitive drums 1Y, 1M, 1C, and 1K by the image forming units SY, SM, SC, and SK, respectively. Each of the latent images is developed to form a toner image of the respective colors. The toner images of the respective colors formed on the photosensitive drums 1 of the image forming units S are then sequentially transferred at the corresponding one of the primary transfer portions N1Y, N1M, N1C, and N1K and sequentially superimposed on the intermediate transfer belt 8, thus forming a four-color toner image on the intermediate transfer belt 8.

A transfer material P, such as a recording sheet stacked in a sheet feeding cassette 24 as a sheet storage unit is conveyed to a registration roller 28 by a sheet feeding roller (not illustrated) and a conveyance roller (not illustrated). The transfer material P is conveyed to the secondary transfer portion N2, which is formed by the intermediate transfer belt 8 and the secondary transfer roller 15, by the registration roller 28 in synchronization with the toner images on the intermediate transfer belt 8. The four-color multi-toner images borne on the intermediate transfer belt 8 are collectively transferred onto the transfer material P at the secondary transfer portion N2 by the action of the secondary transfer roller 15. At this time, a secondarily transfer power source (not illustrated) applies a secondary transfer voltage having the opposite polarity (which is positive in the present embodiment) to the normal charging polarity of the toner to the secondary transfer roller 15.

Thereafter, the transfer material P with the transferred toner image is conveyed to a fixing unit 16. The toner image transferred onto the transfer material P through the secondary transfer is pressed and heated while a fixing roller and a pressing roller of the fixing unit 16 pinch and convey the transfer material P, whereby the toner image is fixed to the transfer material P, and thereafter the transfer material P is discharged to the outside of the body of the image forming apparatus 100 by a pair of sheet discharge rollers 29.

The residual toner remaining on the photosensitive drum 1 after the primary transfer is removed from the surface of the photosensitive drum 1 by the drum cleaning unit 6. The residual untransferred toner remaining on the intermediate transfer belt 8 after the transfer material P has passed through the secondary transfer portion N2 is removed from the surface of the intermediate transfer belt 8 by the belt cleaning unit 12 provided to face the stretching roller 10 via the intermediate transfer belt 8. The belt cleaning unit 12 is provided downstream of the secondary transfer portion N2 in the moving direction of the intermediate transfer belt 8. The belt cleaning unit 12 includes a cleaning blade 21 (contact member) which is in contact with the outer surface of the intermediate transfer belt 8 at a position facing the stretching roller 10. This configuration will be described in detail below.

A control substrate 25 as a control unit is a control substrate on which an electric circuit for controlling the image forming apparatus 100 is mounted, and a central processing unit (CPU) 26 as a control unit is mounted on the control substrate 25. The control substrate 25 is capable of performing a pre-programmed operation by receiving a signal transmitted from a host device (not illustrated), and the CPU 26 controls various units so that an image forming operation is executed.

The toner used in the present embodiment is manufactured by externally adding fine silica particles having an average particle size of 20 nm to toner particles manufactured through emulsion polymerization aggregation method and having an average particle size of 6.4 μm. The average particle size refers to, for example, a weight average particle size and is measurable by using a Coulter method. An example of a measurement device is a "Coulter Counter Multisizer 3" (manufactured by Beckman Coulter, Inc.). An example of attached dedicated software for setting measurement conditions and analyzing measurement data is a "Beckman Coulter Multisizer 3 Version 3.51" (manufactured by Beckman Coulter, Inc.). A method for manufacturing the toner particles is not limited to the emulsion polymerization aggregation method, and the toner particles can be produced by other methods, such as a pulverization method, suspension polymerization method, or dissolution suspension method.

[Belt Cleaning Unit 12]

Figure 2A:
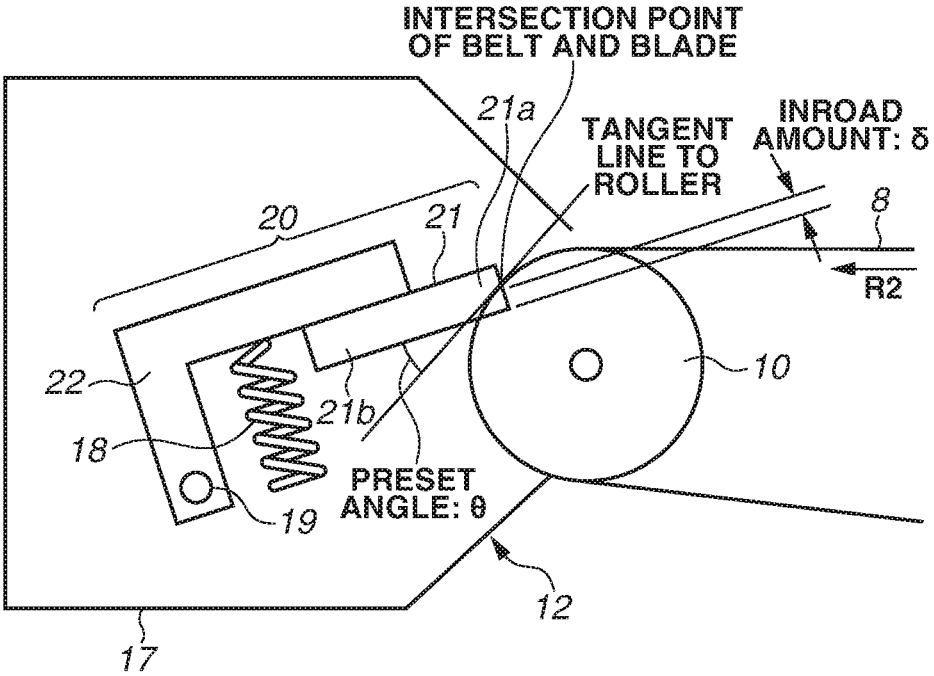
FIGS. 2A and 2B are schematic views each illustrating an example structure of a belt cleaning unit.
Figure 2B:
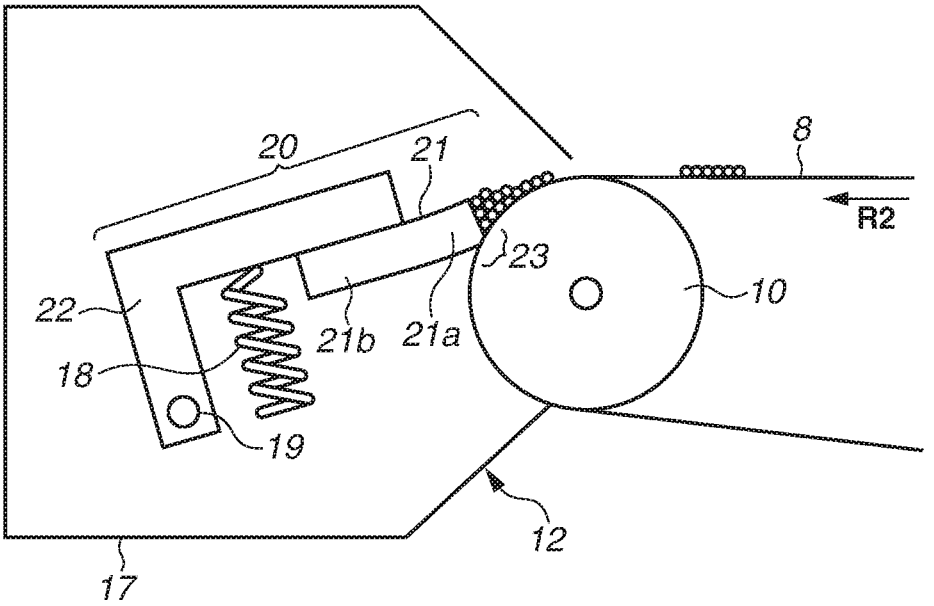

FIG. 2A is a virtual section view illustrating an attachment position of the cleaning blade 21 in a case in which the cleaning blade 21 is not elastically deformed, and FIG. 2B is a schematic section view illustrating a structure of the belt cleaning unit 12.

The belt cleaning unit 12 includes a cleaning container 17 and a cleaning action portion 20 provided in the cleaning container 17. The cleaning container 17 is formed as a part of a housing of an intermediate transfer unit (not illustrated) including the intermediate transfer belt 8. The cleaning action portion 20 includes the cleaning blade 21 and a support member 22. The cleaning blade 21 serves a cleaning member (contact member). The support member 22 supports the cleaning blade 21. The cleaning blade 21 is an elastic blade made of urethane rubber (polyurethane), which is an elastic material, and is supported in a state in which the cleaning blade 21 is bonded to the support member 22 formed by a plate metal including a zinc-plated steel plate as a material.

The cleaning blade 21 is a plate-shaped member having a longer side in the width direction of the intermediate transfer belt 8 (longer-side direction of the cleaning blade 21) which is a direction that intersects the moving direction of the intermediate transfer belt 8 (hereinafter, "belt conveyance direction"). In a shorter-side direction, the cleaning blade 21 is fixed in a state in which an end portion 21*a* on a free end side is in contact with the intermediate transfer belt 8 and an end portion 21*b* on a fixed end side is bonded to the support member 22. The cleaning blade 21 has a length of 240 mm in the longer-side direction, a thickness of 3 mm, and a hardness of 77 degrees according to the Japan Industrial Standards (JIS) K 6253.

The cleaning action portion 20 is formed in such a manner that the cleaning action portion 20 is swingable with respect to the surface of the intermediate transfer belt 8. More specifically, the support member 22 is supported in such a manner that the cleaning action portion 20 is swingable with respect to the surface of the intermediate transfer belt 8 via a pivot shaft 19 fixed to the cleaning container 17. The support member 22 is pressed by a pressing spring 18 provided as a biasing unit in the cleaning container 17 so that the cleaning action portion 20 is moved with the pivot shaft 19 being the center and the cleaning blade 21 is biased (pressed) against the intermediate transfer belt 8.

The stretching roller 10 is provided on the inner surface side of the intermediate transfer belt 8 to face the cleaning blade 21. The cleaning blade 21 is in contact with the surface of the intermediate transfer belt 8 in the counter direction with respect to the belt conveyance direction at the position at which the cleaning blade 21 faces the stretching roller 10. Specifically, the cleaning blade 21 is in contact with the surface of the intermediate transfer belt 8 in such a manner that the end portion 21*a* of the cleaning blade 21 on the free end side in the shorter-side direction faces upstream in the belt conveyance direction. In this way, a blade nip portion 23 is formed between the cleaning blade 21 and the intermediate transfer belt 8, as illustrated in FIG. 2B. At the blade nip portion 23, the cleaning blade 21 scrapes residual untransferred toner from the surface of the intermediate transfer belt 8, which is moving, and collects the scraped toner into the cleaning container 17.

In the present embodiment, the attachment position of the cleaning blade 21 is set as follows. A preset angle θ is 24 degrees, an inroad amount 8 is 1.5 mm, and a contact pressure is 0.49 N/cm as illustrated in FIG. 2A. As used herein, the preset angle θ is an angle formed by a tangent line to the stretching roller 10 at an intersection point of the intermediate transfer belt 8 and the cleaning blade 21 (more specifically, an end face of the cleaning blade 21 on the free end side) and the cleaning blade 21 (more specifically, one of the surfaces that is substantially orthogonal to the thickness direction of the cleaning blade 21). Further, the inroad amount 6 is a length in the direction of a thickness by which the cleaning blade 21 overlaps the stretching roller 10. The contact pressure is defined by a pressing force from the cleaning blade 21 at the blade nip portion 23 (linear pressure in the longer-side direction) and is measured using a film-type pressure measurement system (product name: PINCH, manufactured by Nitta Corporation). This configuration enables prevention or reduction of curling up of the cleaning blade 21 and slip sound under a high temperature and humidity environment, thus achieving excellent cleaning performance. Moreover, these settings enable reduction of cleaning defects under a low temperature and humidity environment, thus achieving excellent cleaning performance.

In general, urethane rubber and synthetic resin each have a high frictional resistance in sliding, and an initial curling up of the cleaning blade 21 is liable to occur. Thus, an initial lubricant, such as graphite fluoride can be applied in advance to the end portion 21*a* of the cleaning blade 21 on the free end side.

The rubber hardness of the cleaning blade 21 is selected as suitable for a material of the intermediate transfer belt 8 and is desirably 70 degrees or more and not more than 80 degrees according to the JIS standards K 6253. If the rubber hardness is lower than this range, the amount of abrasion caused by use can increase to thereby decrease durability. On the other hand, if the rubber hardness is higher than the range, the elastic force decreases and the friction between the cleaning blade 21 and the intermediate transfer belt 8 can produce a chip. The contact pressure of the cleaning blade 21 is selected as suitable for a material of the intermediate transfer belt 8 and is desirably 0.4 N/cm or more and not more than 0.8 N/cm. If the contact pressure is lower than this range, excellent cleaning performance may not be achieved.

If the contact pressure is higher than the range, the load for driving and rotating the intermediate transfer belt 8 can become excessively high.

[Detection Unit 27]

The image forming apparatus 100 according to the present embodiment includes a detection unit 27 for detecting a toner image for detection that is transferred onto the intermediate transfer belt 8, and is capable of executing correction control to correct a position and concentration of an image to be formed based on a result of the detection by the detection unit 27. More specifically, in such a correction control, the detection unit 27 acquires position/concentration information about the toner image for detection that is transferred from the photosensitive drum 1 onto the intermediate transfer belt 8, and feeds back the acquired information for correction of the image forming conditions such as an image position and concentration. The CPU 26 also performs processing to receive a signal from a light receiving element 272 of the detection unit 27 in the case of executing correction control to correct the image forming conditions, such as the position and concentration of an image to be formed by the image forming apparatus 100.

Figure 3A:
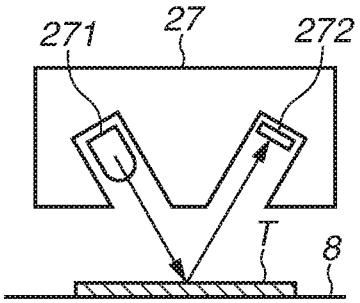
FIGS. 3A, 3B, and 3C are schematic views illustrating concentration correction.
Figure 3B:
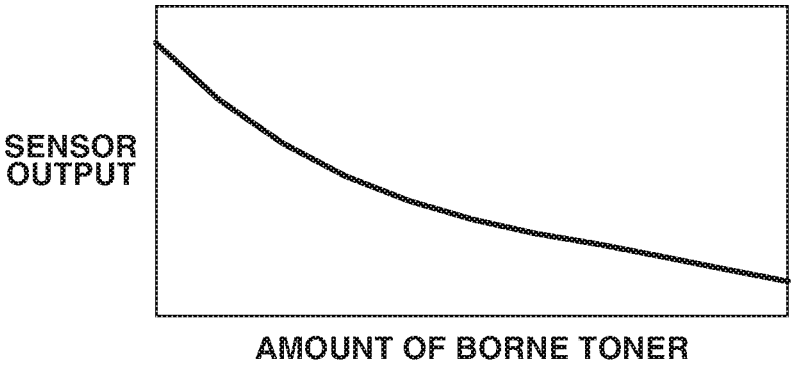
Figure 3C:
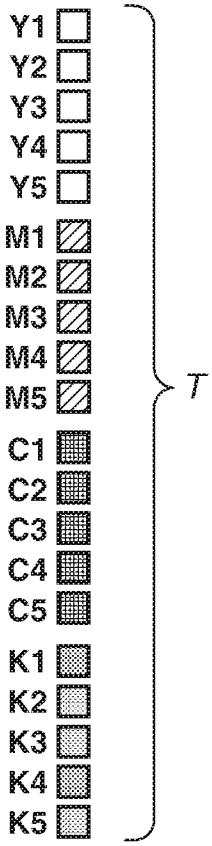

FIG. 3A is a schematic section view illustrating a structure of the detection unit 27. FIG. 3B is a graph illustrating output characteristics of the detection unit 27. FIG. 3C is a schematic view illustrating a pattern of a patch toner T as a toner image for detection that is formed on the intermediate transfer belt 8 at the time of executing correction control to correct the image concentration (hereinafter, referred to as "concentration correction").

As illustrated in FIG. 3A, the detection unit 27 includes a light emitting element 271, such as a light emitting diode (LED), and the light receiving element 272, such as a photodiode. The light receiving element 272 receives specular reflection light from the patch toner T at the time of applying infrared light from the light emitting element 271 to the patch toner T transferred to the intermediate transfer belt 8, whereby the detection unit 27 detects the concentration of the patch toner T.

A curve in FIG. 3B represents the output characteristics of the detection unit 27, and the sensor output decreases as the amount of toner transferred to the intermediate transfer belt 8 (hereinafter, referred to as "amount of borne toner") increases. This is because if the amount of borne toner increases, the applied light is diffused by the toner and, at the same time, the surface of the intermediate transfer belt 8 as a background is covered, so that the specular reflection light from the surface of the intermediate transfer belt 8 decreases.

In the image forming apparatus 100, the concentration of an acquired image varies due to a temperature and/or humidity changes in a surrounding environment of the image forming apparatus 100 or a change in a component of the image forming apparatus 100 as a result of use over a long period of time. Thus, concentration correction needs to be performed regularly to correct changes in image concentration. In the present embodiment, correction is executed if the environment temperature changes by 5 degrees Celsius or more or the number of printed sheets exceeds 1000 from the previous correction. As illustrated in FIG. 3C, in the case of executing concentration correction, from the photosensitive drums 1 of the respective colors (Y, M, C, and K), 8-mm square patches each of which represents a different one of five levels of image printing rates (concentration gradation level) are formed at 10-mm intervals at positions facing the detection unit 27 in the width direction of the intermediate transfer belt 8. The correspondence between each patch and the printing rate (gradation level) is as follows: Y1, M1, C1, and K1=20%, Y2, M2, C2, and K2=40%, Y3, M3, C3, and K3=60%, Y4, M4, C4, and K4=80%, and Y5, M5, C5, and K5=100%. The light receiving element 272 of the detection unit 27 detects reflection light from the patch toner T formed by the above-described patches. The control substrate 25 determines a difference between an ideal amount of borne toner based on the image printing rate and the detected amount of borne toner based on a result of detection by the detection unit 27, and corrects the image printing rate at the time of image forming. The concentration correction according to the present embodiment is performed as described above.

[Intermediate Transfer Belt 8]

Figure 4:
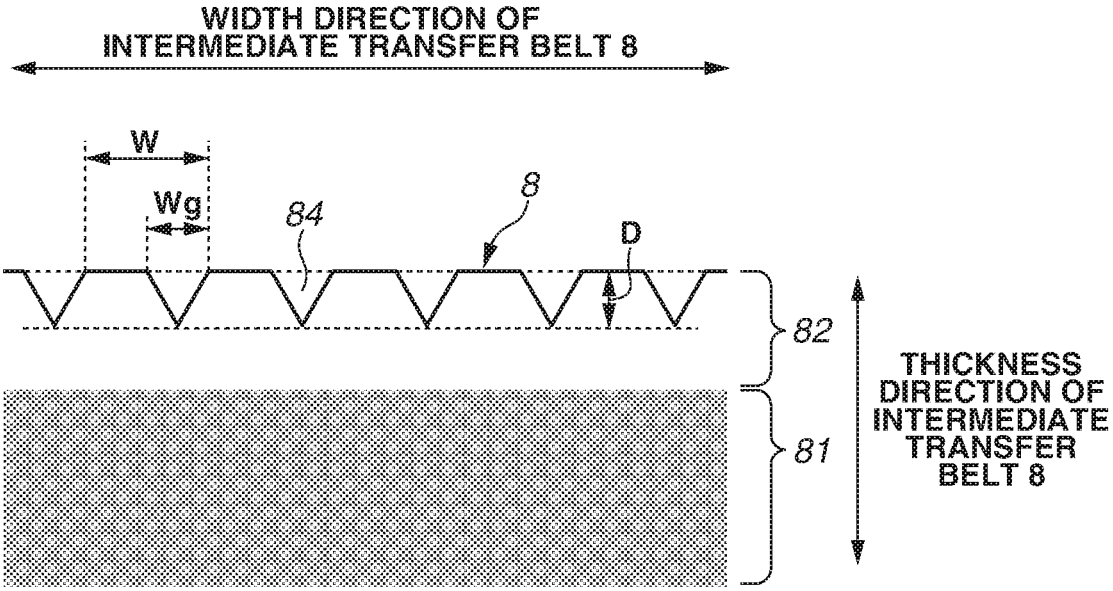
FIG. 4 is a schematic enlarged partial section view illustrating an example structure of an intermediate transfer member.

Next, a form of the intermediate transfer belt 8 that is unique to the present embodiment will be described. FIG. 4 is a schematic enlarged partial section view illustrating the intermediate transfer belt 8 cut along a direction that is substantially orthogonal to the belt conveyance direction (the intermediate transfer belt 8 viewed along the belt conveyance direction).

The intermediate transfer belt 8 is an endless two-layer belt member (or film-shaped member) including a base layer 81 and a surface layer 82. As used herein, the term "base layer" is defined as the thickest layer in the thickness direction of the intermediate transfer belt 8 among the layers of the intermediate transfer belt 8. The surface layer 82 bears the toner image that is primarily transferred from the photosensitive drum 1 onto the intermediate transfer belt 8. In the present embodiment, the base layer 81 is a layer having a thickness of 70 μm and a volume resistivity adjusted to $1\times10^{10}$ Ω·cm by a quaternary ammonium salt as an electric resistance adjustment agent being dispersed in polyethylene naphthalate resin, where the quaternary ammonium salt is an ion conductive agent. The surface layer 82 is a layer that has a thickness of about 3 μm and in which, for example, zinc oxide as an electric resistance adjustment agent is dispersed in acrylic resin as a base material.

A conductive agent (conductive filler, electric resistance adjustment agent) can be added to the surface layer 82 to adjust the electric resistance. An electronic conductive agent or ion conductive agent can be used as the conductive agent. An example of the electronic conductive agent is a carbon-based conductive filler in the form of particles, fibers, or flakes, such as carbon black. Another example is a metal-based conductive filler in the form of particles, fibers, or flakes, such as silver, nickel, copper, zinc, aluminum, stainless-steel, or iron. Yet another example is a metal-oxide-based conductive filler in the form of particles, such as zinc antimonate or tin oxide. Examples of the ion conductive agent include an ionic liquid, conductive oligomer, and quaternary ammonium salt. One or more of the above-described conductive agents are selected as suitable, and an electronic conductive agent and an ion conductive agent may be used in mixture.

While the ion conductive agent is used as the conductive agent to be added to the base layer 81 in the present embodiment, the conductive agent to be added is not limited to the ion conductive agent. An electronic conductive agent may be added to impart conductivity, or a mixture of an electronic conductive agent and an ion conductive agent can be added to impart conductivity. For the ion conductive agent or the electronic conductive agent, the conductive agents described above as conductive agents that can be added to the surface layer 82 can be used.

Materials of the base layer 81 and the surface layer 82 are not limited to the above-described materials and can be any other materials. Examples of the material that can be used for the base layer 81 include, other than the polyethylene naphthalate resin, thermoplastic resins, such as polycarbonate, polyvinylidene fluoride (PVDF), polyethylene, polypropylene, polymethylpentene-1, polystyrene, polyamide, polysulfone, polyarylate, polyethylene terephthalate, polybutylene terephthalate, polyethylene naphthalate, polyphenylene sulfide, polyethersulfone, polyethernitrile, thermoplastic polyimide, polyether ether ketone, thermotropic liquid crystal polymer, and polyamide acid. Two or more of the above-described materials can be used in mixture.

With regard to the surface layer 82, examples of an organic material other than acrylic resin include curable resins, such as melamine resin, urethane resin, alkyd resin, fluorine-based curable resin (fluorine-contained curable resin). Examples of the inorganic material include an alkoxysilane-alkoxyzirconium-based material and silicate-based material. Examples of an organic/inorganic hybrid material include an inorganic fine particle-dispersed organic polymer-based material, inorganic fine particle-dispersed organoalkoxysilane-based material, acrylic silicon-based material, and organoalkoxysilane-based material.

From the point of view of strength, such as abrasion resistance and crack resistance of the surface layer 82 of the intermediate transfer belt 8, a resin material (curable resin) is desirable among the curable materials, and an acrylic resin obtained by curing an unsaturated double bond-containing acrylic copolymer is desirable among the curable resins.

In general, urethane rubber and acrylic resin have a high frictional resistance in sliding, and abrasion resulting from curling up or wear of the cleaning blade 21 is liable to occur. Thus, according to the present embodiment, the surface layer 82 is surface-treated to reduce abrasion of the cleaning blade 21, and grooves (groove shape, groove portion) 84 are formed along the belt conveyance direction. More specifically, as illustrated in FIG. 4, the plurality of grooves 84 is formed through processing of forming fine asperities along the moving direction (the direction of the arrow R2 in the drawings) of the intermediate transfer belt 8 in the width direction of the intermediate transfer belt 8 which intersects the moving direction of the intermediate transfer belt 8.

There are publicly-known methods for forming fine asperities, such as polishing process, cutting process, and imprint process. A suitable method is selected from among these methods and used to obtain the intermediate transfer belt 8 having a surface with the grooves 84 formed therein according to the present embodiment. In terms of processing cost and productivity, it is desirable to perform imprint processing using the light-curable property of the acrylic resin as a base material of a surface on which the process for forming fine asperities is performed. The grooves 84 may be formed by curing the acrylic resin and thereafter performing lapping processing.

According to the present embodiment, the grooves 84 are formed on the surface of the intermediate transfer belt 8 through imprint processing in which a mold (not illustrated) with fine asperities is pressed against the intermediate transfer belt 8 to transfer the shape of the mold, the fine asperities, to the surface layer 82 of the intermediate transfer belt 8. In the present embodiment, the grooves 84 are formed for an entire loop of the intermediate transfer belt 8 along the moving direction of the intermediate transfer belt 8.

A width Wg specified in FIG. 4 is the width of an opening portion of the grooves 84 in the width direction of the intermediate transfer belt 8 and is defined as a range where the thickness of the surface layer 82 is formed, as the groove, to be thin in the outermost surface of the surface layer 82. For example, the grooves 84 each have a width Wg of 1 μm. A depth D specified in FIG. 4 is defined as a depth in the thickness direction of the intermediate transfer belt 8 from a surface, of the surface layer 82, in which no groove is formed (opening portion) to a bottom portion of the grooves 84. The depth D is 0.2 μm or more and less than the thickness of the surface layer 82, and the grooves 84 are formed in such a manner than the grooves 84 do not reach the base layer 81 and are present only on the surface layer 82.

The width Wg of the groove 84 is desirably less than a half of the average particle size of toner. Setting the width Wg of the groove 84 to less than the average particle size of the toner enables the toner to be prevented from entering the groove 84 and slipping through the cleaning blade 21 at the blade nip portion 23. By contrast, if the width Wg of the groove 84 is excessively narrow, the contact area of the cleaning blade 21 and the intermediate transfer belt 8 becomes excessively large. This increases the friction at the blade nip portion 23, and may promote abrasion at the front edge of the cleaning blade 21. Thus, in the structure according to the present embodiment, it is desirable that the width Wg of the groove 84 be set within the range of 0.5 μm to 3 μm.

An interval W specified in FIG. 4 is a measured distance between starting points of adjacent grooves 84 and is defined as an interval between right-end portions of the opening portions of the adjacent grooves 84. The average interval between the grooves 84 defined in the present embodiment is an average value of the intervals W of a plurality of grooves 84 in the width direction of the intermediate transfer belt 8. In the present embodiment, the grooves 84 are formed with the interval W set to 20 μm. The interval W can also be defined as an interval between left-end portions of the opening portions of the adjacent grooves 84 or as an interval between bottom portions of the opening portions of the adjacent grooves 84.

The thickness of the surface layer 82 needs to be thick enough for the grooves 84 to be formed. In other words, the thickness needs to be equal to or more than the depth D of the grooves 84. If the thickness of the surface layer 82 is less than the depth D of the grooves 84, the grooves 84 may reach the base layer 81 and a material added to the base layer 81 may be precipitated on the surface of the surface layer 82, which may cause a cleaning defect. If the thickness of the surface layer 82 is excessively thick, the surface layer 82 made of acrylic resin may crack, which may cause a cleaning defect. Thus, in the structure according to the present embodiment, it is desirable that the thickness of the surface layer 82 be set within the range of 1 μm to 5 μm. In view of a crack on the surface layer 82 after long-term use, it is further desirable that the thickness of the surface layer 82 be set within the range of 1 μm to 3 μm.

A solid lubricant may be added to the surface layer 82. The solid lubricant can be selected as suitable from among fluorine-containing particles, such as polytetrafluoroethylene (PTFE) resin powder, vinyl fluoride resin powder, and graphite fluoride, and copolymers thereof. Adding the solid lubricant to the surface layer reduces the frictional resistance between the cleaning blade 21 and the intermediate transfer belt 8. Thus, the solid lubricant may be added, as an auxiliary method for adjusting the frictional resistance between the cleaning blade 21 and the intermediate transfer belt 8.

Figure 5A:
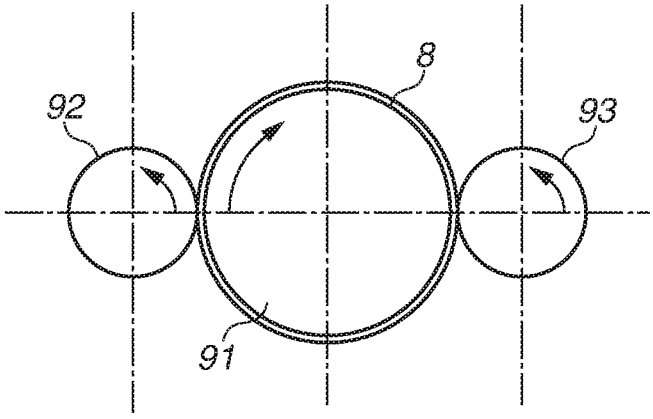
FIGS. 5A, 5B, and 5C are schematic views illustrating imprint processing according to a first embodiment.
Figure 5B:
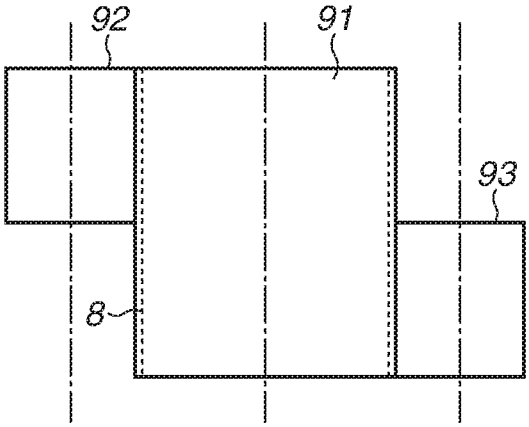
Figure 5C:
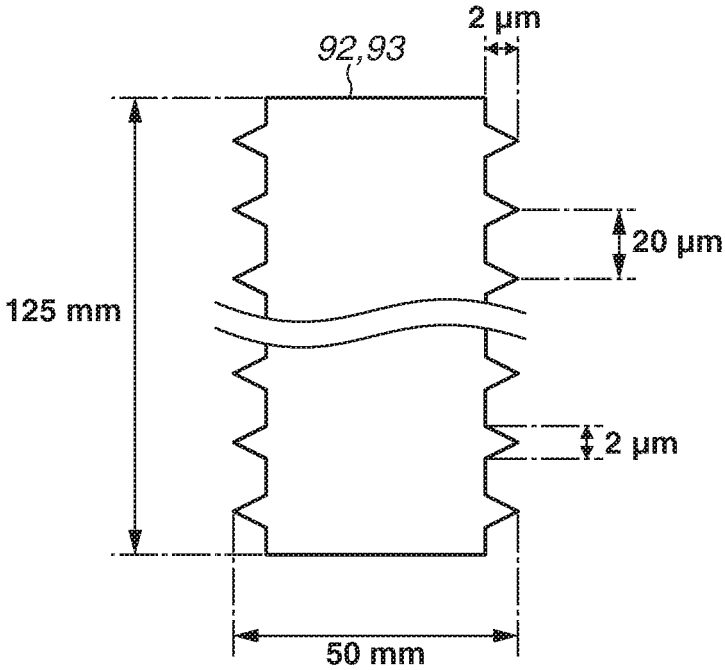

The grooves 84 are formed in the intermediate transfer belt 8 according to the present embodiment through imprint processing using two molds divided in the width direction of the intermediate transfer belt 8. Details of the imprint processing according to the present embodiment will be described with reference to FIGS. 5A to 5C. FIG. 5A is a schematic view illustrating an imprint processing apparatus viewed from the top in a direction of the cylindrical axis of a core 91 which is used for the intermediate transfer belt 8 (described below). FIG. 5B is a schematic section view illustrating the imprint processing apparatus taken along a direction that is parallel to the cylindrical axis of the core 91 which is used for the intermediate transfer belt 8. FIG. 5C is a section view illustrating the molds to be used in imprint processing.

In the case of forming the grooves 84 through imprint processing, first, the intermediate transfer belt 8 in the state in which the surface layer 82 is formed on the base layer 81 is pressed into a core 91 (diameter 227 mm, made of carbon tool steel material). Secondly, cylindrical molds 92 and 93 having a diameter of 50 mm and a length of 125 mm are arranged on the surface of the intermediate transfer belt 8 that is pressed into the core 91 such that an entire region of a width of 250 mm in the width direction of the intermediate transfer belt 8 can be processed. More specifically, the molds 92 and 93 are shifted in phase by 180 degrees with the core 91 situated between the molds 92 and 93, and shifted in position by 125 mm so that end portions of the molds 92 and 93 are positioned at a center of the width in the width direction of the intermediate transfer belt 8. The molds 92 and 93 are then brought into pressure contact with the intermediate transfer belt 8 at a pressing force of 2500 N.

As illustrated in FIG. 5C, triangular protrusions are formed parallel to a circumferential direction of the cylinder at 20-μm regular intervals on the surfaces of the molds 92 and 93. The triangular protrusions are formed through cutting processing in such a manner that the length of the bottom of each protrusion is 2.0 μm and the height is 2.0 μm. In the case of forming the grooves 84 in the intermediate transfer belt 8, the molds 92 and 93 are heated by a heater (not illustrated) to a temperature of 130 degrees Celsius, which is higher by 5 to 15 degrees Celsius than the glass transition temperature of polyethylene naphthalate. With the heated molds 92 and 93 being in contact with the core 91, the core 91 is rotated once at a circumferential of speed 264 mm/s, and then the molds 92 and 93 are separated from the core 91. While the core 91 is being rotated, the molds 92 and 93 are driven and rotated by the rotation of the core 91. In the present embodiment, surface shape processing is performed as described above to thereby form the grooves 84 on the surface layer 82 of the intermediate transfer belt 8.

Figure 6A:
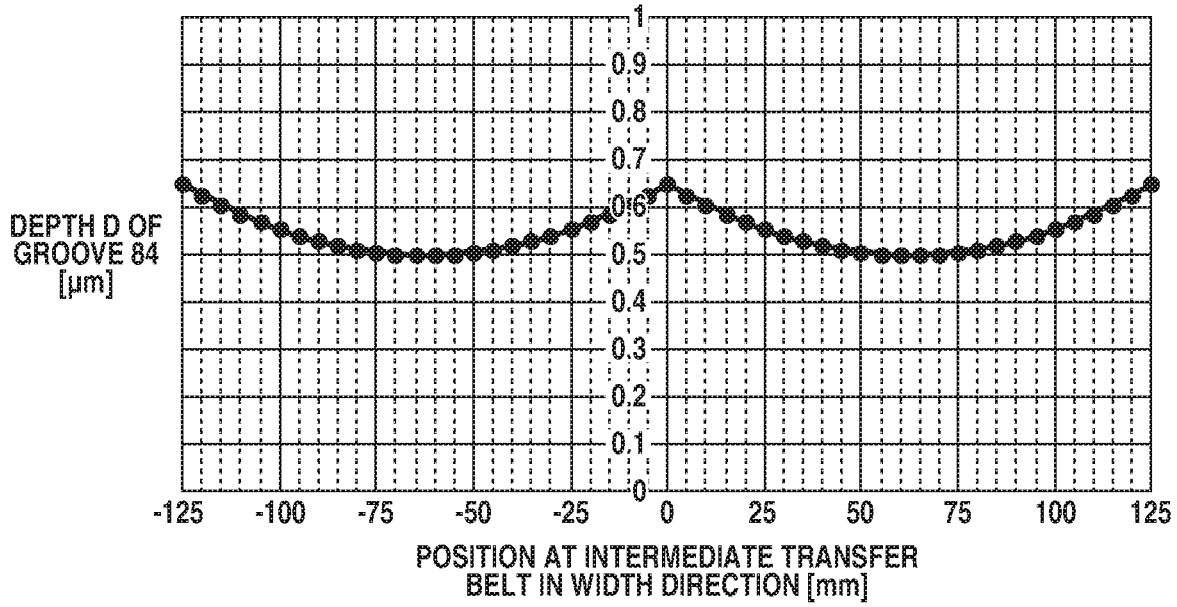
FIGS. 6A and 6B are graphs illustrating a groove depth distribution in a width direction of the intermediate transfer member according to the first embodiment and a distribution of an average.
Figure 6B:
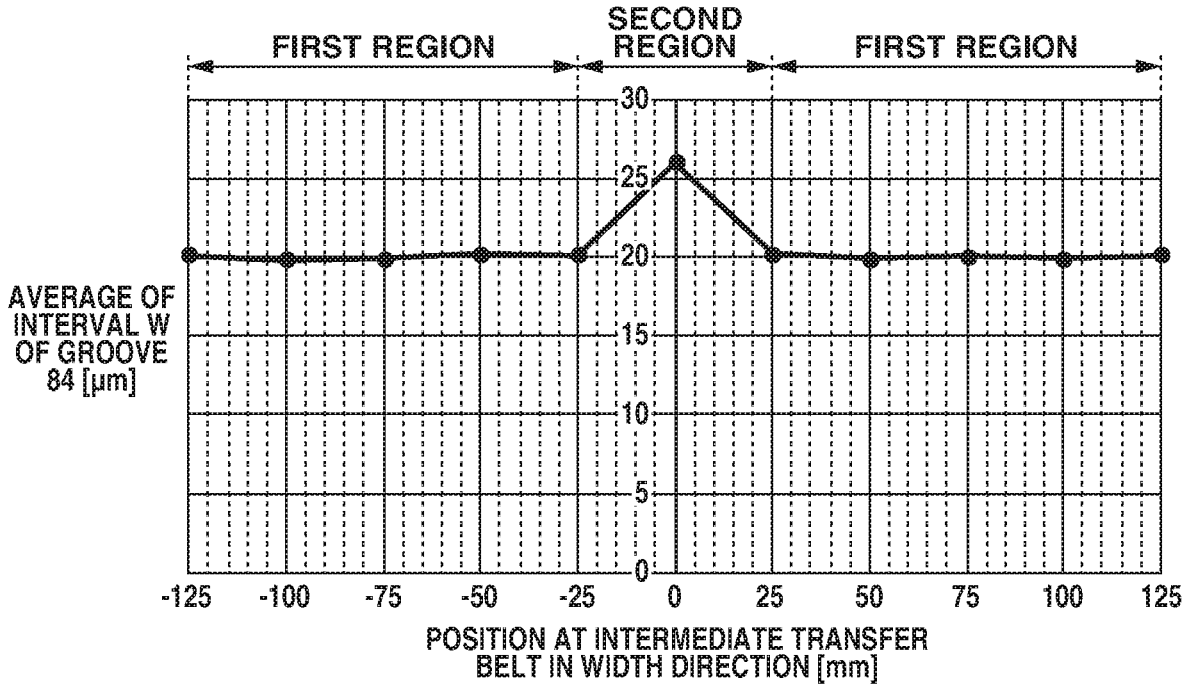

The depth D and the interval W of the groove 84 formed through surface shape processing as described above were measured using a laser microscope (VK-X250 manufactured by Keyence Corporation) and specified in FIGS. 6A and 6B. FIG. 6A is a graph illustrating a result of distribution measurement of the depth D of the groove 84 in the width direction of the intermediate transfer belt 8. FIG. 6B is a graph illustrating an average of the intervals W at respective positions in the width direction of the intermediate transfer belt 8. In the graphs in FIGS. 6A and 6B, the position at the center of the intermediate transfer belt 8 in the width direction is specified as zero, and the front side in the depth direction in FIG. 1 is specified as plus and the back side as minus. As illustrated in FIG. 6A, the depth D of the groove 84 in the intermediate transfer belt 8 according to the present embodiment was in the range of 0.5 μm to 0.65 μm, and there was a tendency that the grooves were shallower at a central portion of the mold and the depth D of the groove 84 increased toward an end portion of the mold.

As illustrated in FIG. 6B, the distribution of the averages of the intervals W of the grooves 84 was about 20 μm across the entire region in the width direction, except that the interval W increased only in a center portion in the width direction and was about 26 μm. In other words, the intermediate transfer belt 8 according to the present embodiment includes a plurality of first regions in which the grooves 84 are cyclically formed with the average of the intervals W of the grooves 84 being 20 μm (predetermined interval) in the width direction of the intermediate transfer belt 8 and a second region in which the interval W of the grooves 84 is 26 μm. The average of the intervals W of the grooves 84 according to the present embodiment is calculated as follows. First, a distribution of the interval W, which is the distance between the starting points of adjacent grooves 84 as illustrated in FIG. 4, is measured at predetermined positions in the width direction in the width range of 200 μm, and average is obtained. Then, similar measurement is further performed on eight positions in the moving direction of the intermediate transfer belt 8, and the measurement results were averaged to thereby obtain an average of the intervals W of the grooves 84 at the respective positions in the width direction.

<Comparison with Typical Example>

Figure 7A:
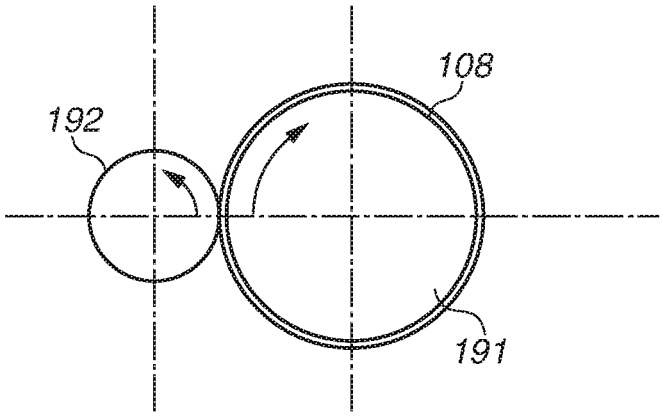
FIGS. 7A, 7B, and 7C are schematic views illustrating imprint processing according to a typical example.
Figure 7B:
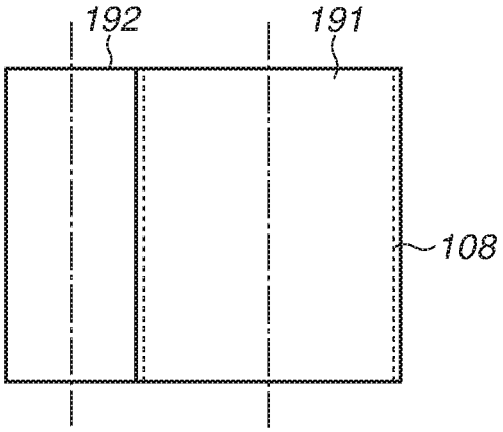
Figure 7C:
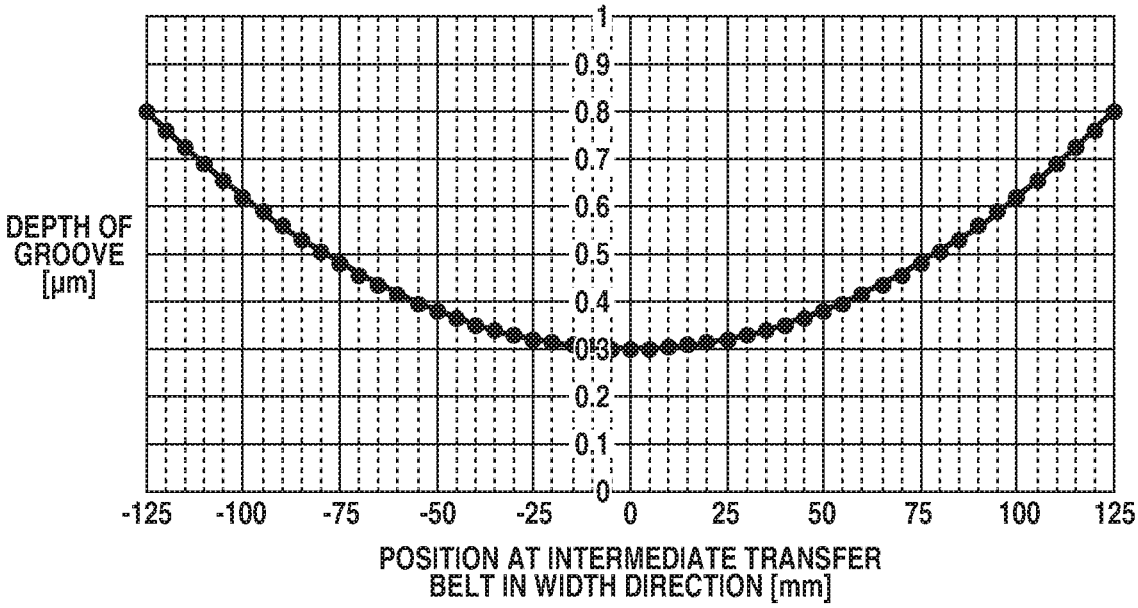

FIG. 7A is a schematic view illustrating an imprint processing apparatus viewed from the top in a direction of a cylindrical axis of a core 191 which is used for the intermediate transfer belt 108 (described below) in the typical example configuration in which imprint processing is performed with the mold not being separate. FIG. 7B is a schematic sectional view illustrating the imprint processing apparatus taken along a direction that is parallel to the cylindrical axis of the core 191 which is used for the intermediate transfer belt 108, in the typical example. FIG. 7C is a graph illustrating a measurement result for a groove depth distribution with respect to the width direction of the intermediate transfer belt 108 in the typical example.

In the configuration of the typical example, imprint processing is performed on the intermediate transfer belt 108 using a mold 192 having a width of 250 mm in the longer-side direction with the mold 192 being not divided as illustrated in FIG. 7B. In the typical example, the pressing force for the mold 192 is set to 5000 N, which is double the pressing force in the present embodiment, because the mold length in the typical example is double the mold length in the present embodiment. Imprint processing conditions in the typical example are substantially similar to those in the present embodiment, except that the mold 192 and the pressing force from the mold 192 are different. Thus, the description of similar points is omitted in the below-described comparison.

As illustrated in FIG. 7C, the grooves were formed with a depth of 0.3 μm to 0.8 μm in the typical example, and the depth variation is more than trebled compared to the variation of the depths D of the groove 84 in the present embodiment as illustrated in FIG. 6A. In the structure according to the typical example in which the mold 192 which is long in the longer-side direction is pressed against a core cylinder 191, since the pressing force is strong, deformation of the mold 192 occurring at the time of the press increases. As a result, the groove depth variation between the end and central portions of the intermediate transfer belt 108 increases. Consequently, the coefficient of friction between the cleaning blade 21 and the intermediate transfer belt 108 can also varies, so that the amount of abrasion of the cleaning blade 21 also varies as the image forming operation continues. Depending on the level of the variation, the toner may slip through a damaged portion of the cleaning blade 21, which may cause a cleaning defect. Thus, it may become difficult to sufficiently improve durability of the cleaning blade 21.

By contrast, in the configuration in which imprint processing is performed using the molds 92 and 93 divided in the width direction of the intermediate transfer belt 8 as in the present embodiment, the mold length in the longer-side direction is decreased so that a uniform pressure can be applied with ease to the intermediate transfer belt 8. This enables reduction or prevention of the variation in the depths D of the grooves 84 in the width direction of the intermediate transfer belt 8, thus reducing the amount of abrasion of the cleaning blade 21 and enabling improvement in durability of the cleaning blade 21, as described above.

While the mold is divided into two by 125 mm with respect to the width of 250 mm of the intermediate transfer belt 8 in the present embodiment, an advantageous effect of the present embodiment is also produced by the number of times of dividing the mold being increased. For example, a groove depth variation was reduced in a first modified embodiment in which the mold was divided into three molds with a width of 83.3 mm and the pressing force was set to 1667 N and in another modified embodiment in which the mold was divided into four molds with a width of 62.5 mm and the pressing force was set to 1250 N, as in the present embodiment.

While, for the width of 250 mm of the intermediate transfer belt 8, the mold is equally divided into two molds by 125 mm and the processing is performed using the two molds in the present embodiment, the configuration is not limited thereto. A similar advantageous effect of the present embodiment can also be produced through the process in which the position of one mold is shifted and the processing is performed across the entire region of the surface of the intermediate transfer belt 8. In such a case, for example, the mold 93 is not used and the mold 92 is made one rotation at the position specified in FIG. 5B and the processing is performed. The mold 92 is then separated from the core 91, and the mold 92 is brought into contact with the core 91 again at a position shifted downward by 125 mm from the position specified in FIG. 5B. The mold 92 is made one rotation and the processing is performed. The mold 92 is then separated from the core 91, whereby an intermediate transfer belt having a groove depth similar to that in the present embodiment is obtained.

While the imprint processing is employed as a method for forming fine asperities on the surface of the intermediate transfer belt 8 in the present embodiment, an advantage effect of the present embodiment is also produced using a different processing method. For example, in the processing apparatus according to the present embodiment and a processing apparatus according to a comparative embodiment, a lapping film may be sandwiched between the intermediate transfer belt and the mold to form asperities on the surface of the intermediate transfer belt, using the mold as a pressing member without a protrusion shape of a mold surface and without temperature control using a heater. The processing was performed using a lapping film with abrasive grain having a particle size of 6 μm, under the same conditions for the mold pressing force and the rotation speed of the core 91 as those in the present embodiment and the typical example, and grooves with an average groove depth of 0.5 μm were formed. The distribution of the groove depth in the width direction of the intermediate transfer belt 8 was measured, and the groove depth was about 0.35 μm to 0.65 μm in the case in which the mold was not divided, whereas the groove depth was about 0.42 μm to 0.58 μm in the case in which the mold was divided, that is, a less variation was obtained for the case with divided molds.

<Cleaning in Correction Control>

Figure 8:
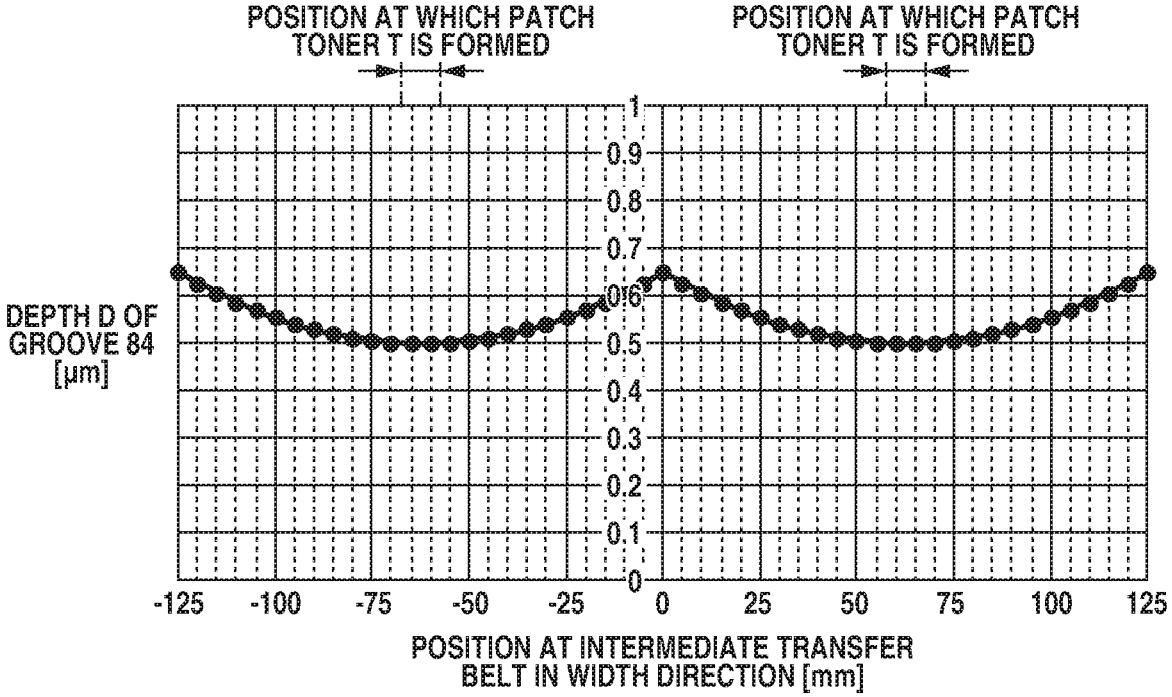
FIG. 8 is a graph illustrating a relationship between a position at the intermediate transfer member in a width direction and a position at which a toner image for detection is formed, and the groove depth distribution according to the first embodiment.

FIG. 8 is a graph illustrating a relationship between a position at the intermediate transfer belt 8 in the width direction and a position at which the patch toner T (toner image for detection) is formed, and the distribution of the depth D of a groove 84 according to the present embodiment. In the present embodiment, a different one of detection units 27 is provided at respective positions of ±62.5 mm from the center of the intermediate transfer belt 8 in the width direction of the intermediate transfer belt 8.

In the cleaning at the time of forming an image on a transfer material P, the belt cleaning unit 12 collects residual untransferred toner remaining on the intermediate transfer belt 8 after the secondary transfer is performed in the secondary transfer portion N2 from the intermediate transfer belt 8 to the transfer material P. In the correction control in which the patch toner T is formed, such as concentration correction, the patch toner T transferred onto the intermediate transfer belt 8 is completely collected by the belt cleaning unit 12. In other words, in the correction control for correcting the image forming conditions, a larger amount of toner arrives at the cleaning blade 21 than that in normal image forming.

Figure 9:
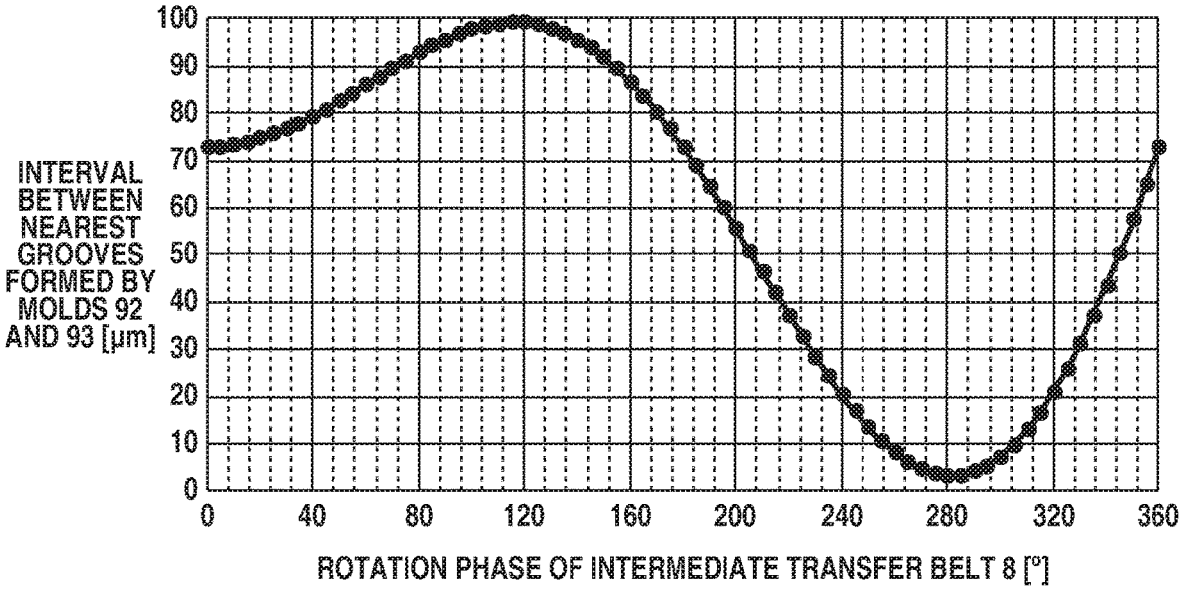
FIG. 9 is a graph illustrating a relationship between a phase in a circumferential direction of the intermediate transfer member and a groove interval in a second region according to the first embodiment.

FIG. 9 illustrates a measurement result of an interval between a groove that is formed in the intermediate transfer belt 8 by the mold 92 in the second region and is located at the shortest distance from the center in the width direction and a groove that is formed in the intermediate transfer belt 8 by the mold 93 in the second region and is located at the shortest distance from the center in the width direction with respect to the moving direction of the intermediate transfer belt 8. In other words, FIG. 9 illustrates a measurement result of the interval between adjacent grooves in the second region in the moving direction of the intermediate transfer belt 8. As illustrated in FIG. 9, it is understood that the interval between the grooves formed by the protrusions of the end portions of the molds 92 and 93 varies from 0 μm to 100 μm based on the phase of the intermediate transfer belt 8 in the circumferential direction. In other words, in the second region, the friction force generating between the intermediate transfer belt 8 and the cleaning blade 21 varies in the circumferential direction. This is considered to occur as follows. At the time of forming the grooves 84 in the intermediate transfer belt 8, the molds 92 and 93 which are driven and rotated by the core 91 are slightly moved in the cylindrical shaft direction of the molds 92 and 93, which changes the distance between the molds 92 and 93 due to the rotation phase of the core 91.

By contrast, the interval W of the grooves 84 in the first region in the circumferential direction of the intermediate transfer belt 8 was also measured, and only a variation of about 19.5 μm to 20.5 μm was measured. In other words, in the first region, the friction force generating between the intermediate transfer belt 8 and the cleaning blade 21 was not in the state of varying in the circumferential direction. This is considered to occur because even if the molds 92 and 93 are operated in the cylindrical shaft direction of the molds 92 and 93 during imprint processing, since the interval W of the grooves 84 is determined based on the intervals of the protrusions formed in the molds 92 and 93, no variation occurred, unlike the second region.

As described above, in the second region, the friction force generating between the intermediate transfer belt 8 and the cleaning blade 21 varies in the circumferential direction of the intermediate transfer belt 8. Thus, in the present embodiment, the grooves 84 are formed on the surface layer 82 of the intermediate transfer belt 8 in such a manner that the second region is provided outside the range in which the patch toner T is to be formed in the correction control, such as concentration correction. In this way, the patch toner T which is difficult to clean is formed at a position at which the intervals W and the depths D of the grooves 84 are stable, thus enabling reduction or prevention of cleaning defects while durability of the cleaning blade 21 is improved.

[Evaluation of Cleaning Performance]

A description is provided of evaluation results of cleaning performance of the structures according to the present embodiment and a first comparative embodiment. The first comparative embodiment is different from the present embodiment in that the detection unit is provided in the second region and concentration correction is performed with the patch toner T formed in the second region in the width direction of the intermediate transfer belt 8 according to the present embodiment. Except for the position of the detection unit and the position at which the patch toner T is to be formed, the structure according to the first comparative embodiment is substantially similar to the structure according to the present embodiment. Thus, similar components are given the same reference numeral and description thereof is omitted.

In the present embodiment, in executing concentration correction, the patch toner T illustrated in FIG. 3C was formed at the positions of +62.5 mm in the width direction of the intermediate transfer belt 8, which were the positions at which the detection units 27 were provided. In the first comparative embodiment, in executing concentration correction, the patch toner T was formed at the position of ±0 mm in the width direction of the intermediate transfer belt 8, which were the positions at which the detection unit was provided.

The cleaning performance evaluation was performed by checking whether the toner slipped through the cleaning blade 21 in the durability evaluation in which a text image with a printing rate of 5% was formed on a plurality of transfer materials P, and the cleaning performance was evaluated based on the total number of printed sheets at the time when a cleaning defect occurred. More specifically, an operation of continuously forming an image of a printing rate of 5% on 1000 transfer materials P and then performing concentration correction was repeated through durability evaluation. Whether or not a cleaning defect occurred was determined by checking whether a streak-shaped image defect occurred, which is a sign of the toner having slipped through the transfer material P on which an image was formed immediately after concentration correction was executed. In the above-described evaluation, A4-size GF-C081 sheets (manufactured by Canon Inc.) were used under a temperature of 30 degrees Celsius and a humidity of 80%.

TABLE 1

| | Timing at which Toner Slipped through |
|---|---|
| First Comparative Embodiment | Not Before 121,000 sheets |
| First Embodiment | Not Before 243,000 sheets |

Table 1 indicates cleaning performance evaluation results of the present embodiment and the first comparative embodiment. As indicated in Table 1, it is understood that the timing at which the toner slipped through the cleaning blade 21, in the structure according to the present embodiment is later than that in the first comparative embodiment and high cleaning performance is achieved through durability. Further, the rubber edge of the cleaning blade 21 in each of the structures according to the first comparative embodiment and the first embodiment was observed at the timing at which the toner slipped through. In the observation, a chip of about 20 μm was found at a central portion in the width direction, corresponding to the second region, and a chip of about 10 μm was found at a position of ±50 mm to ±75 mm in the width direction, corresponding to the first region, and consequently the toner slipped through.

The region of the position of ±50 mm to ±75 mm in the intermediate transfer belt 8 in the width direction is a region where the depth D of the groove 84 is about 0.5 μm and is relatively shallow. Thus, in this region, the friction between the intermediate transfer belt 8 and the cleaning blade 21 is relatively large, so that it is considered that the cleaning blade 21 chipped. By contrast, as illustrated in FIG. 6A, the depth D of the groove 84 in the central portion in the width direction which corresponds to the second region is about 0.65 μm, which is a deep region. However, in the second region, as illustrated in FIG. 6B, the average of the intervals W of the grooves 84 is wide and is about 26 μm, so that is it considered that the friction force generating between the cleaning blade 21 and the intermediate transfer belt 8 became strong, and thus the chip of 20 μm occurred.

Accordingly, in the second region, the cleaning blade 21 is liable to chip. In the case of cleaning a large amount of residual toner remaining on the intermediate transfer belt 8, such as the patch toner T, the toner is likely to slip through and a cleaning defect is likely to occur. Thus, as in the present embodiment, providing the second region outside the range where the patch toner T is to be formed enables reduction of cleaning defects while improving durability of the cleaning blade 21.

While the mold is equally divided into two by 125 mm with respect to the width of 250 mm of the intermediate transfer belt 8 in the present embodiment, an advantage effect of the present embodiment is also produced even if the widths of the molds 92 and 93 are not equal. For example, effects with a configuration has been checked in which the mold was divided into a mold with a width of 100 mm and a mold with a width of 150 mm, and the processing was performed at a pressing force of 2000 N and a pressing force of 3000 N. The evaluation processing was then performed. In each structure, the toner did not slip through before 243,000 sheets.

While the present embodiment has been described with reference to the image concentration adjustment operation, a similar advantage effect is also produced in a case of performing an adjustment operation by detecting the position of the toner image for detection that is transferred onto the intermediate transfer belt 8 and then correcting a deviation in image forming if the structure according to the present embodiment is employed.

A second embodiment of the present disclosure will be described below. In the first embodiment, a description is provided of the intermediate transfer belt 8 including the plurality of first regions in which the interval w of grooves 84 formed by the molds 92 and 93 is 20 μm and a second region which is formed between the plurality of first regions and in which the interval of grooves formed by the molds 92 and 93 is 26 μm. By contrast, in the second embodiment, the interval of the grooves in the second region that is at the center of an intermediate transfer belt 208 in the width direction of the intermediate transfer belt 208 and corresponds to a joint of the groove shapes transferred from the molds 92 and 93 is set shorter than that in the first embodiment. More specifically, in FIG. 5B, imprint processing is performed with the mold 93 shifted closer to the mold 92 by 0.1 mm so that a region to be processed with the mold 92 and a region to be processed with the mold 93 overlap. In this way, the second region is formed. The structure according to the present embodiment is substantially similar to the structure according to the first embodiment, except that the interval of the grooves in the second region is different from that in the first embodiment. Thus, similar components are given the same reference numeral and description thereof is omitted.

Figure 10A:
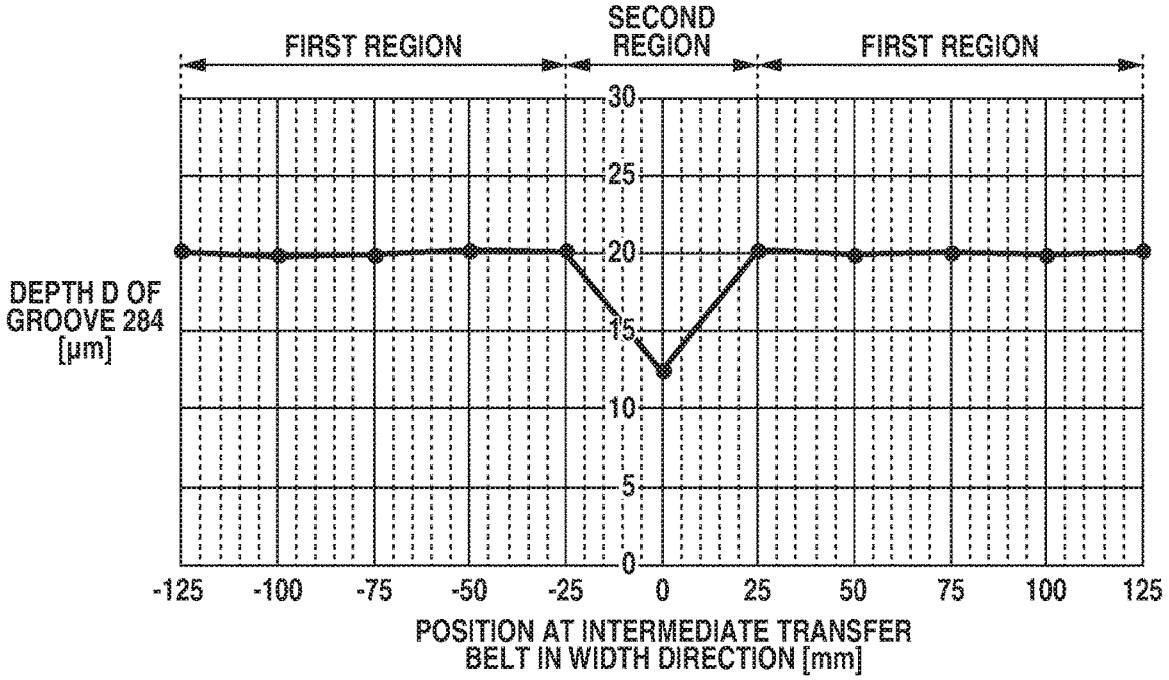
FIGS. 10A and 10B are graphs illustrating the average of the groove depth distribution in the width direction of the intermediate transfer member and the relationship between the phase in the circumferential direction of the intermediate transfer member and the groove interval in the second region according to a second embodiment.
Figure 10B:
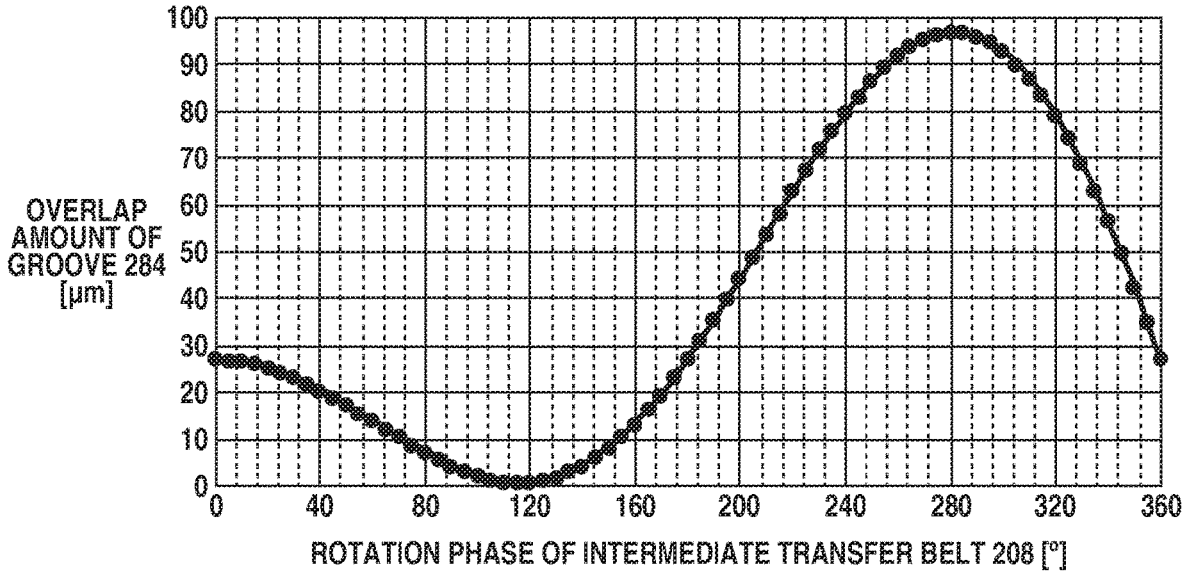

FIG. 10A is a graph illustrating a distribution of averages of the interval W of grooves 284 at positions in the width direction of the intermediate transfer belt 208. FIG. 10B illustrates a measurement result of an overlap amount of the grooves 284 formed in the intermediate transfer belt 8 by the molds 92 and 93 in the second region in the moving direction of the intermediate transfer belt 208. In other words, FIG. 10B illustrates a measurement result of the interval of adjacent grooves in the second region in the moving direction of the intermediate transfer belt 8.

As illustrated in FIG. 10A, in the present embodiment, the second region in which the grooves 284 overlap is provided in the width direction of the intermediate transfer belt 208 to thereby eliminate the portion in which the interval of the grooves 84 is wide in the second region according to the first embodiment. This configuration enables the friction force generating between the intermediate transfer belt 208 and the cleaning blade 21 in the second region to be reduced, thus reducing or preventing chip of the cleaning blade 21.

As illustrated in FIG. 10A, the distribution of the averages of the interval W of the grooves 284 was about 20 μm in the width direction nearly across the entire region, but the interval W was narrow at the center portion in the width direction and was about 13 μm. In other words, the intermediate transfer belt 208 according to the present embodiment includes the plurality of first regions in which the average of the interval W of the grooves 284 is 20 μm (predetermined interval) and the second region in which the interval of the grooves 284 is 13 μm in the width direction of the intermediate transfer belt 208.

As illustrated in FIG. 10B, the overlap amount of the grooves 284 varies based on the phase in the circumferential direction in the region that corresponds to the second region and in which the grooves 284 formed by the molds 92 and 93 overlap, even in the present embodiment. More specifically, the interval of the grooves 284 became shorter by 100 μm than that in the first embodiment and varied in the range of −100 μm to 0 μm based on the phase in the circumferential direction. The portion in which the interval of the grooves 284 is a negative value is in a state in which imprint processing is performed twice, and, with a double number of groove lines, the interval between the adjacent grooves becomes shorter than 20 μm.

[Evaluation of Cleaning Performance]

The structure according to the present embodiment can also produce an advantage produced by the first embodiment if the second region is formed outside the region where the patch toner T is formed. Table 2 shows cleaning performance evaluation results of the present embodiment and the first comparative embodiment. As shown in Table 1, it is understood that the timing at which the toner slipped through in the structure according to the present embodiment is later than that in the first comparative embodiment and high cleaning performance is achieved through durability. The cleaning evaluation method is similar to that in the first embodiment, so that description thereof is omitted.

TABLE 2

| | Timing at which Toner Slipped through |
|---|---|
| First Comparative Embodiment | Not Before 121,000 sheets |
| Second Embodiment | Not Before 201,000 sheets |

The rubber edge of the cleaning blade 21 in the structure according to the second embodiment was checked at the timing at which the toner slipped through after 201,000 transfer materials P, as in the first comparative embodiment and the first embodiment. A chip of about 5 μm was found in a central portion, in the width direction, corresponding to the second region, and a chip of about 10 μm was found at a position of ±50 mm to ±75 mm in the width direction in a region corresponding to the first region, as in the first embodiment. Since the chip of about 10 μm occurred in the structure according to the first comparative embodiment at the timing at which 121,000 transfer materials P were passed, it was found that overlapping the grooves 284 in the second region according to the present embodiment can reduce chips in the cleaning blade 21.

Meanwhile, since the number of lines of the grooves 84 is doubled in the structure according to the present embodiment, there may be a situation in which the friction force generating between the intermediate transfer belt 208 and the cleaning blade 21 in the second region becomes excessively low. In other words, if the patch toner T with a large amount of toner is conveyed to the blade nip portion 23 which corresponds to the second region, a cleaning defect can occur due to a combination of decreased performance caused by a chip and the excessively-low friction state.

Thus, in the structure according to the present embodiment, providing of the second region outside the range where the patch toner T is formed enables the patch toner T, which is difficult to clean, to be formed at a position at which the interval W and the depth D of the grooves 284 are stable. This enables reduction of cleaning defects while improving durability of the cleaning blade 21, as in the first embodiment.

While the mold is equally divided into two by 125 mm with respect to the width of 250 mm of the intermediate transfer belt 8 in the present embodiment, this is not a limiting case. As described above in the first embodiment, an advantageous effect similar to that produced by the present embodiment is produced if the number of times of dividing the mold is further increased or the molds are arranged in such a manner that groove shapes to be transferred to the intermediate transfer belt from the molds overlap each other.

While the mold is equally divided into two by 125 mm with respect to the width of 250 mm of the intermediate transfer belt 8 and the processing is performed using the two molds in the present embodiment, this is not a limiting case. For example, an advantage effect of the present embodiment is also produced if the position of one mold is shifted to thereby form grooves across the entire surface of the intermediate transfer belt or if the mold is shifted and then a region in which grooves are previously formed and a region in which grooves are to be formed subsequently are arranged to overlap and processed.

Further, while the mold is equally divided into two by 125 mm with respect to the width of 250 mm of the intermediate transfer belt 8 in the present embodiment, this is not a limiting case. As described above in the first embodiment, an advantage effect of the present embodiment is also produced if the widths of the molds 92 and 93 are not equal or the molds are arranged in such a manner that groove shapes to be transferred to the intermediate transfer belt from the molds overlap each other.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2018-087524, filed Apr. 27, 2018, which is hereby incorporated by reference herein in its entirety.

What is claimed is:

1. An image forming apparatus comprising:

an image bearing member configured to bear a toner image;

an intermediate transfer member which is movable and is in contact with the image bearing member, the toner image borne on the image bearing member being primarily transferred onto the intermediate transfer member, a collection unit which is provided downstream, in a moving direction of the intermediate transfer member, of a secondary transfer portion in which the primarily-transferred toner image on the intermediate transfer member is secondarily transferred from the intermediate transfer member onto a transfer material, wherein the collection unit includes a contact member in contact with the intermediate transfer member, and is configured to collect, using the contact member, toner remaining on the intermediate transfer member after the toner image passes through the secondary transfer portion;

a detection unit configured to detect a toner image for detection which is transferred from the image bearing member onto the intermediate transfer member; and a control unit configured to execute, based on a result of detection by the detection unit, correction control to correct an image forming condition for forming an image using the toner image, wherein the intermediate transfer member includes, on a surface thereof in contact with the image bearing member and the contact member, a plurality of grooves formed along the moving direction with respect to a width direction of the intermediate transfer member which intersects the moving direction, and wherein the intermediate transfer member includes, a plurality of first regions in which adjacent grooves of the plurality of grooves in the width direction are arranged at a predetermined interval, and a second region which is positioned between the plurality of first regions and in which an interval between adjacent grooves of the plurality of grooves in the width direction is different from the predetermined interval, the second region being arranged outside, in the width direction, a range in which the toner image for detection is to be formed in the correction control.

2. The image forming apparatus according to claim 1, wherein the adjacent grooves in the width direction in the plurality of first regions are cyclically arranged at the predetermined interval, and, with respect to the width direction, a width of the first region is wider than a width of the second region.

3. The image forming apparatus according to claim 1, wherein the interval between the adjacent grooves in the second region is wider than the predetermined interval.

4. The image forming apparatus according to claim 1, wherein the interval between the adjacent grooves in the second region is narrower than the predetermined interval.

5. The image forming apparatus according to claim 1, wherein the plurality of grooves in the second region are formed with the interval between the adjacent grooves varying based on a phase in the moving direction of the intermediate transfer member.

6. The image forming apparatus according to claim 1, wherein the intermediate transfer member includes a base layer that is the thickest layer in a thickness direction of the intermediate transfer member among a plurality of layers of intermediate transfer member, and the layer on which the plurality of grooves is formed is a surface layer formed on a surface of the base layer.

7. The image forming apparatus according to claim 6, wherein the base layer is a layer to which an ion conductive agent is added.

8. The image forming apparatus according to claim 6, wherein the surface layer has a thickness of 1 μm or more and not more than 5 μm.

9. The image forming apparatus according to claim 8, wherein the thickness of the surface layer is 3 μm or less.

10. The image forming apparatus according to claim 6, wherein the surface layer is a layer to which a solid lubricant is added.

11. The image forming apparatus according to claim 1, wherein the contact member is a blade made of polyurethane.

12. The image forming apparatus according to claim 1, wherein the contact member has a Japanese Industrial Standards rubber hardness standard K 6253 of 70 degrees or more and not more than 80 degrees.

13. The image forming apparatus according to claim 1, wherein the contact member has a contact pressure of 0.4 N/cm or more and not more than 0.8 N/cm for the intermediate transfer member.

* * * * *